US007515845B2

(12) United States Patent
Kishi et al.

(10) Patent No.: US 7,515,845 B2
(45) Date of Patent: Apr. 7, 2009

(54) METHOD FOR SUPPLYING POWER, AND FIXING AND IMAGE FORMING APPARATUSES

(75) Inventors: Kazuhito Kishi, Kanagawa-ken (JP); Yasuhisa Kato, Kanagawa-ken (JP); Akiyasu Amita, Kanagawa-ken (JP); Masami Okamoto, Kanagawa-ken (JP); Hiromasa Takagi, Tokyo (JP); Yasutada Tsukioka, Chiba-ken (JP); Ryuichi Kikegawa, Miyagi-ken (JP); Susumu Matsusaka, Kanagawa-ken (JP); Naoki Sato, Kanagawa-ken (JP)

(73) Assignee: Ricoh Company, Ltd., Tokyo (JP)

( * ) Notice: Subject to any disclaimer, the term of this patent is extended or adjusted under 35 U.S.C. 154(b) by 141 days.

(21) Appl. No.: 11/221,816

(22) Filed: Sep. 9, 2005

(65) Prior Publication Data

US 2006/0051119 A1 Mar. 9, 2006

(30) Foreign Application Priority Data

Sep. 9, 2004 (JP) ..... 2004-261742

(51) Int. Cl.
*G03G 15/20* (2006.01)
*G03G 15/00* (2006.01)

(52) U.S. Cl. ..... 399/69; 399/88

(58) Field of Classification Search ..... 399/69, 399/70, 88

See application file for complete search history.

(56) References Cited

U.S. PATENT DOCUMENTS

2004/0149740 A1* 8/2004 Kishi et al. ..... 219/660
2006/0237446 A1 10/2006 Kishi et al.
2007/0071479 A1 3/2007 Semma et al.
2007/0098433 A1 5/2007 Yano et al.

OTHER PUBLICATIONS

U.S. Appl. No. 11/609,467, filed Dec. 12, 2006, Kishi, et al.
U.S. Appl. No. 11/678,854, filed Feb. 26, 2007, Yano, et al.

* cited by examiner

*Primary Examiner*—David M Gray
*Assistant Examiner*—Joseph S. Wong
(74) *Attorney, Agent, or Firm*—Oblon, Spivak, McClelland, Maier & Neustadt, P.C.

(57) ABSTRACT

A fixing apparatus includes a first heat generating member that generates heat upon receiving power from a commercial power source, an electrical condenser that stores charge when charged by the commercial power source, and a second heat generating member that generates heat upon receiving power from the electrical condenser. A fixing member is heated by the first and second heat generating members and fixes an image onto a recording medium. A control device is provided to restrict the power supplied from commercial power source to the first heat generating member when the temperature of the fixing member starts increasing. The electrical condenser starts supplying power to the second heat generating member before the control device terminates restriction of the power.

10 Claims, 8 Drawing Sheets

METHOD FOR SUPPLYING POWER, AND FIXING AND IMAGE FORMING APPARATUSES

CROSS REFERRENCE TO RELATED APPLICATION

This application claims priority under 35 USC § 119 to Japanese Patent Application No. 2004-261742 filed on Sep. 9, 2004, the entire contents of which are herein incorporating by reference.

COPYRIGHT NOTICE

A portion of the disclosure of this patent document contains material, which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

BACKGROUND OF THE INVENTION

1. Field of the Invention

The present invention relates to a fixing apparatus, an image forming system employing the fixing apparatus, and a method of controlling power sources to supply power to the fixing apparatus.

2. Discussion of the Background Art

It is known that a power stored in a secondary battery is supplied to an auxiliary heater of a fixing apparatus when sheets are successively fed, as discussed in Japanese Patent Application Laid Open No. 2000-98799. It is also known that a condenser supplies power to an auxiliary heat generating member included in a heat applying apparatus when a system starts up, as discussed in Japanese Patent Application Laid Open No. 2002-184554.

These conventional apparatuses generally employ a halogen heater as a heat-generating member, because of excellent efficiency of heating and starting up quickly.

A problem is an inrush current that is generated when a fixing apparatus or the like utilizes a halogen heater and power is supplied. That is, a large current flows because a resistance of a filament included in the halogen heater is small in an ambient temperature. Specifically, a current of from dozens to a hundred and dozens of Amperes flows through a circuit in a moment. This inrush current gives adverse affect to peripheral instruments because switching parts melt and a power source voltage temporary decreases. When a typical halogen heater having about 1200 w when a commercial power source of 100V is applied is used, both a filament temperature and a resistance increase, and the inrush current is accordingly settled. Thus, a steady current starts flowing.

In order to avoid such an inrush current and resolve a problem of delayed starting up, the above-mentioned inrush current is conventionally decreased by controlling a duty cycle from dozens of hundred mili seconds to one second (i.e., executing soft ON control) in order to restrict a power when a power source is turned on. However, this method takes a long time until temperature of the filament of the halogen heater increases to a prescribed level, and accordingly, heat applied to a fixing roller by generating a light by itself from the halogen heater delays. Even such a time period of from dozens of hundred mili to one second raises a significant problem when temperature is increased within ten seconds as expected by a user.

Further, in order to reduce the inrush current flowing from the commercial power source to the halogen heater, so called "soft control" is executed to restrict a power supplied from the commercial power source when temperature starts increasing so that a rated current of the commercial power source due to the inrush current is not exceeded. However, such soft control delays the halogen heater in starting up, and accordingly delays a fixing roller as a heating objective in increasing temperature. However, a fixing apparatus for copier use is expected nowadays to quickly start up and accordingly save power consumed during warming up as environment protection increasingly receives attention. Thus, a certain technology is demanded to decrease a rated power using soft control and quickly increase temperature of the fixing roller.

SUMMARY OF THE INVENTION

Accordingly, an object of the present invention is to address and resolve such and other problems and provide a new and novel a fixing apparatus. The new and noble fixing apparatus includes a first heat generating member that generates heat upon receiving power from a commercial power source, an electrical condenser that stores charge when charged by the commercial power source, and a second heat generating member that generates heat upon receiving power from the electrical condenser. A fixing member is heated by the first and second heat generating members and fixes an image onto a recording medium. A control device is provided to restrict the power supplied from commercial power source to the first heat generating member when the temperature of the fixing member starts increasing. The electrical condenser starts supplying power to the second heat generating member before the control device terminates restriction of the power.

In another embodiment,

In another embodiment, a control device is provided to output a turn on signal to turn on a switching element when sheets are continuously fed. The control device outputs a turn off signal to turn off the switching element only when a power supply stop signal is generated after a prescribed time period has elapsed from when the power supply start signal is generated.

In yet another embodiment, the heat generating section includes a halogen heater.

In yet another embodiment, the turn off signal is generated when the continuous sheet feeding is terminated.

In yet another embodiment, the turn off signal is generated when temperature of the fixing member exceeds a prescribed level.

BRIEF DESCRIPTION OF DRAWINGS

A more complete appreciation of the present invention and many of the attendant advantages thereof will be readily obtained as the same becomes better understood by reference to the following detailed description when considered in connection with the accompanying drawings, wherein:

FIG. 10 illustrates an exemplary sequence of supplying both AC and DC powers during sheet through.

DESCRIPTION OF THE PREFERRED EMBODIMENTS

Figure 1:
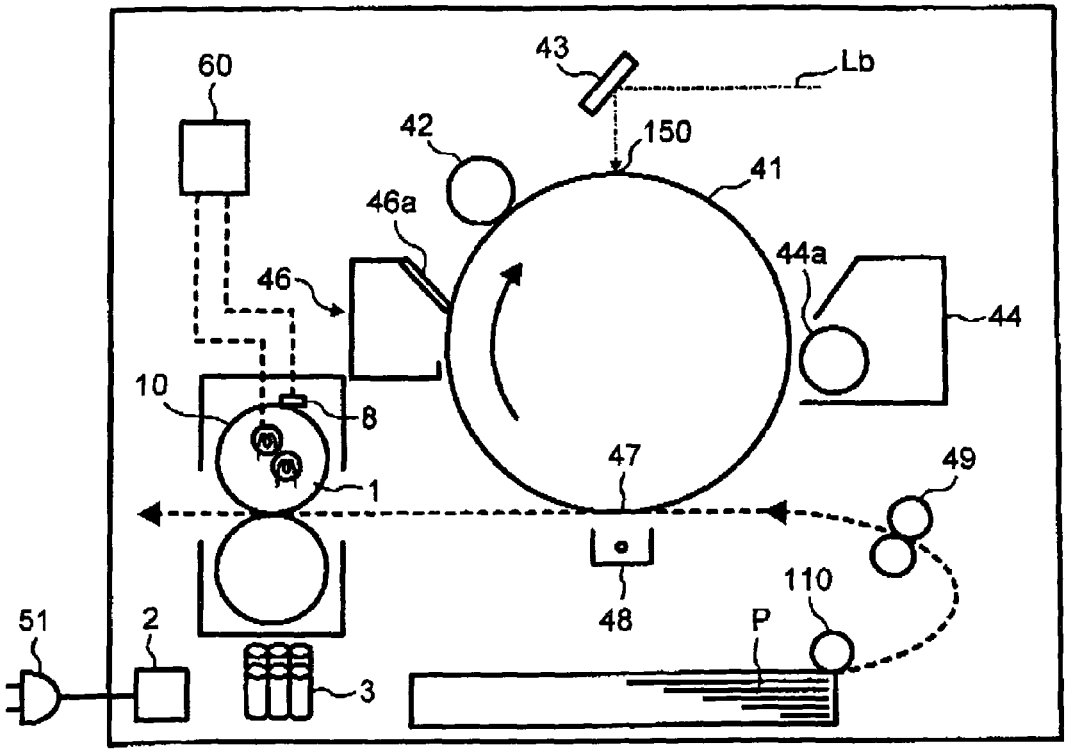
FIG. 1 illustrates an exemplary image forming system employing a fixing apparatus.

Referring now to the drawing, wherein like reference numerals designate identical or corresponding parts throughout several views, in particular to FIG. 1, an exemplary image forming system is illustrated. As shown, a photoconductive member 41 as an image bearer having a drum shape rotates in a prescribed direction as shown by an arrow. A discharge apparatus 42 formed from a charge roller, a mirror 43 partially forming an exposure device, a developing apparatus 44 having a developing roller 44*a*, a transfer apparatus 48 that transfers a visualized image onto a transfer sheet serving as a recording member P, and a cleaning apparatus 46 having a blade 46*a* that sliding contacts the surface of the photo-conductive member 41 etc., are provided around the photo-conductive member 41 in the rotational direction. The photoconductive member 41 is scanned by an exposure light Lb through a mirror 43 at an exposure section 150 between the discharge apparatus 42 and the developing roller 44*a*.

The transfer apparatus 48 opposes the lower surface of the photoconductive member 41 at a transfer section 47. A pair of registration rollers 49 are arranged upstream of the transfer section 47 in the rotational direction of the photoconductive member 41. A recording member P accommodated in a sheet-feeding tray (not shown) is launched by a sheet-feeding roller 110 toward the pair of registration rollers 49 while being guided by a conveyance guide (not shown). A fixing apparatus 10 is arranged downstream of the transfer section 47.

An exemplary image formation is in the below described manner. First, the photoconductive member 41 starts rotating. The discharge apparatus 42 uniformly applies charges onto the photoconductive member 41 in the dark during the rotation of the photoconductive member 41. The exposure light Lb is emitted and scans the exposure section 150, thereby forming a latent image corresponding to an image to be formed. The latent image moves as the photoconductive member 41 rotates to the developing apparatus 44 and is developed with toner, thereby being visualized as a toner image.

Simultaneously, as mentioned above, the recording member P on the sheet feeding tray is fed by the sheet feeding roller 110, and is temporally stopped at the pair of registration roller 49 via a conveyance path shown by a dotted line to be fed in synchronism with a toner image carried on the photoconductive member 41 at the transfer section 47. The registration roller 49 then rotates at a preferable time and feeds the recording member P stopping there toward the transfer section 47. Then, the toner image is transferred onto the recording member P by the transfer apparatus 48 in an electric field.

The recording member P carrying the toner image formed in an image formation section around the photoconductive member 41 is then fed toward the fixing apparatus 10. The toner image is fixed to the recording member P during passage through the fixing apparatus 10, and is ejected onto an ejection section (not shown).

The toner left on the photoconductive member 41 arrives at the cleaning apparatus 46 as the photoconductive member 41 rotates and is cleaned during passage of the cleaning apparatus 46. Thus, the photoconductive member 41 becomes ready for the next image formation.

Figure 2:
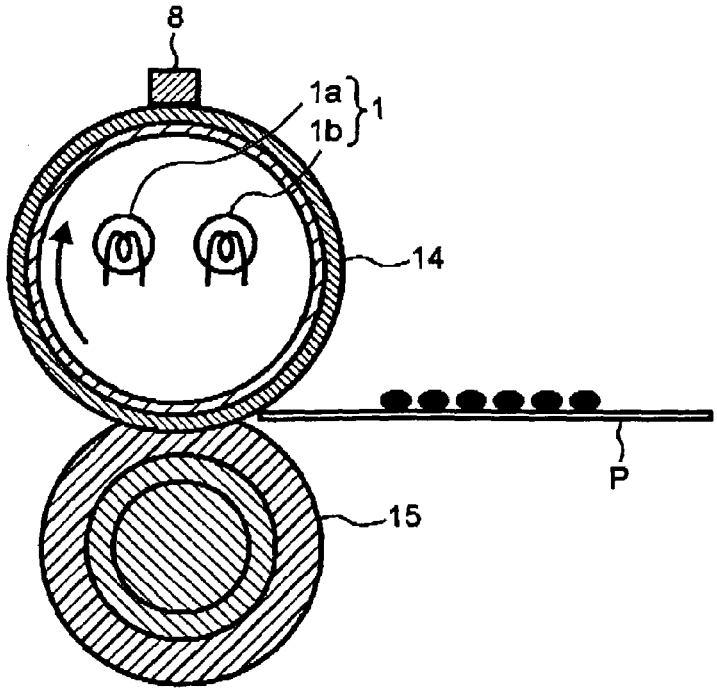
FIG. 2 illustrates an exemplary fixing apparatus according to one embodiment of the present invention.
Figure 3:
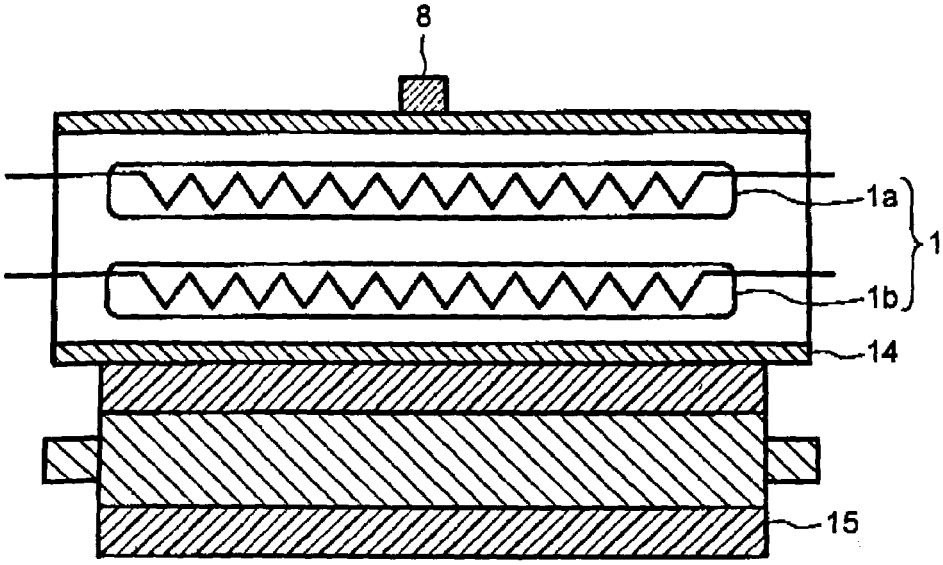
FIG. 3 illustrates an exemplary fixing apparatus according to one embodiment of the present invention.
Figure 4:
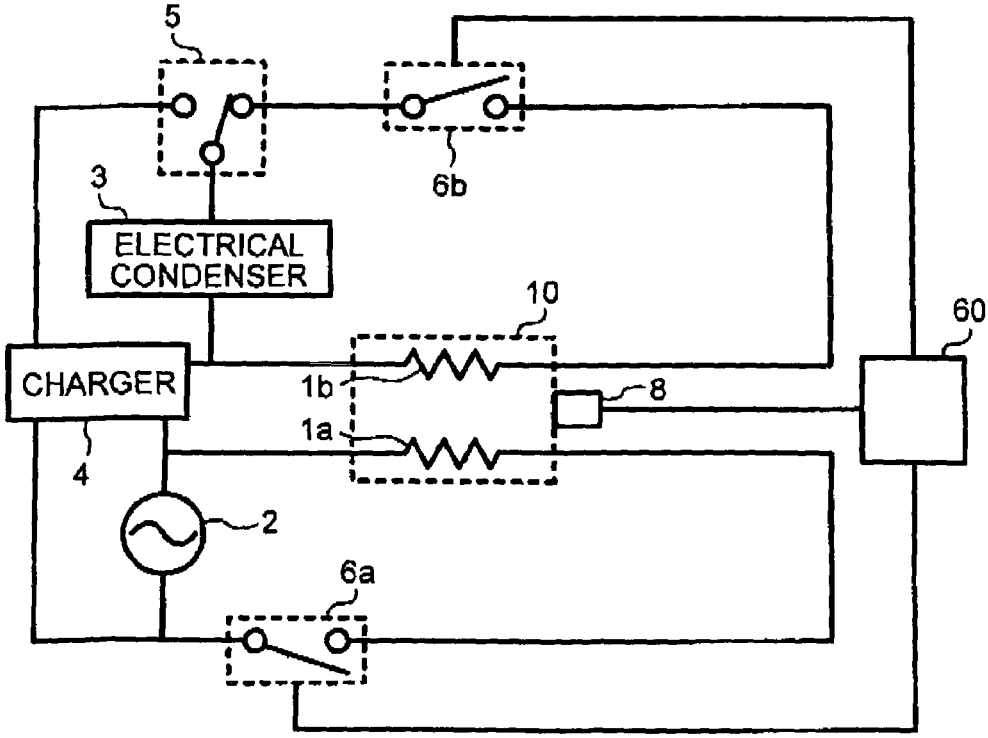
FIG. 4 illustrates an exemplary circuit employed in the fixing apparatus of FIGS. 2 and 3.

As shown in FIGS. 2 to 4, the fixing apparatus 10 includes a fixing member 14 having a heat applying section 1, a pressure applying member 15, and the fixing section temperature-detecting device 8. As shown in FIG. 4, the fixing apparatus 10 further includes a control device 60 that controls power to be supplied from the auxiliary power source 3 (?) to the fixing apparatus 10 in accordance with temperature information transmitted from the fixing section temperature detecting device 8.

The fixing section temperature-detecting device 8 is arranged in the vicinity of the center of the fixing section in the longitudinal direction so as to detect every size of the recording members P. The fixing section temperature detecting device 8 is formed from one of a thermistor, a thermocouple, a ultraviolet light temperature detecting apparatus and the like so as to transmit temperature information to the control device 60. The control device 60 at least controls starting, stopping, and adjusting an amount of power supplied to the heat-applying device 1 based upon temperature information obtained from the fixing section temperature-detecting device 8. Further, as shown in FIG. 4, the fixing apparatus 10 includes a switch to be turned on and off as a power control device (e.g. AC use 6*a*, DC use 6*b*) based upon an instruction of the control device 60. Further, supposing a case of out of control of a system, a safety apparatus is provided to terminate supplying power and maintain safety in such a situation by cutting off a circuit using thermostats 7*a* and 7*b* (THST_AC and THST_DC), and a relay apparatus 9 and the like. Details of the apparatus will be mentioned later.

A main power source 2 is provided to supply power to various units arranged at sections of an image forming system while obtaining a power from a commercial power source. Similar to a typical instrument, power can be supplied to the respective units of the image forming system when a plug of a power source line is inserted into a plug outlet of the commercial power source.

An auxiliary power source 3 is provided and includes an electrical condenser, such as an electric double layer capacitor, an electric double layer condenser, etc. The auxiliary power source 3 condenses power discharged by the main power source 2, and supplies the power in addition to that supplied from the main power source 2. Thereby, a large power can be supplied to the image forming system. Every power source, such as secondary battery types of Li ion and nickel hydrogen, a dummy capacity capacitor that utilizes oxidation-reduction, etc., can be used to store electricity beside the electric double layer capacitor as far as they output a DC.

As mentioned above, the heat applying section 1 includes a plurality of AC and DC heat generating members 1*a* and 1*b* (hereinafter referred to as main and auxiliary heat generating members). The fixing apparatus 14 includes a charger 4, a charge-discharge switching device 5, a main power control device 6*a* that controls power supplying from the main power source 2, and an auxiliary power control device 6*b* that controls power supplying from the auxiliary power source 3.

The main heat generation member 1*a* generates heat when a current is flown to a filament formed in a glass tube thereof. A halogen heater is employed in each of these AC and DC heat generating members 1*a* and 1*b*. However, since those are designed to handle a DC large power, an induction heating device and a ceramic heater can be employed beside the halogen heater.

One halogen heater generating 1200 W when 100V is applied is utilized for the main heat generating member 1*a*. However, two heaters can be employed to heat both ends of the fixing member 14 in an axial direction and a central portion.

The auxiliary heat generation member 1*b* generates heat upon receiving power supplied from the auxiliary power source 3 and similarly heats the fixing member 14. However, a halogen heater generating 600 W when 50V is applied can be employed. A halogen heater generating 700 w when 100V is applied can be utilized, to heat both side ends distanced by about 310 mm so as to cover an A4 size (JIS) sheet when it is laterally fed.

A roller base member of the fixing member 14 is preferably made of metal such as aluminum in view of durability and anti-deformation considering application of pressure. A releasing layer is preferably formed on the surface of the roller so as to suppress sticking of toner thereto. Black processing is preferably applied to the inner surface of the roller so as to efficiently absorb heat of the halogen heater. Further, a belt type-fixing mechanism (not shown) can be employed while forming a nip instead of the roller.

The pressure-applying member 15 is formed from a core metal and an elastic layer such as rubber etc., wrapping the metal core to form a nip, in cooperation with the fixing member 14. A non-fixed toner image formed on a recording member P is fixed thereon by both heat and pressure when being fed through the nip section. A heat-generating member (not shown) can be employed in the pressure-applying member 15 to generate heat upon receiving power from the auxiliary power source 3. A pressure roller having a foam layer can be employed for the pressure member 15 to form a nip in cooperation with the fixing member 14. In such a situation, since heat of the fixing member 14 is difficult to be conveyed to the pressure roller owing to heat insulation effect of the foam layer, temperature of the fixing member 14 can quickly increases.

The auxiliary power source 3 charges and supplies electric power to the auxiliary heat generation member 1*b*. The auxiliary power source 3 can previously store power supplied from the main power source 2 after the charger 4 adjusts the voltage of the power. Further, an auxiliary power can be supply to the heat applying section 1 (i.e., the auxiliary heat generation member 1*b*) at an optional time under control of a charge/discharge switching device 5.

Specifically, the main power source 2 obtains power from the commercial power source through the plug 51 and the plug outlet, and supplies respective units of the image forming system therewith. A current is sometimes restricted to about 15 Ampere and 100 Voltage, and 1500 Watt is sometimes supplied from the main power source 2 as the maximum power depending upon a country. Further, functions, such as voltage adjustment, rectification from alternate to direct currents, voltage stabilization, etc., can be included in the main power source 2.

A main power control device 6*a* is provided to control power supplied to the fixing member 14 from the main power source 2, and executes a switching operation to turn on and off in accordance with an instruction from the control device 60 having a CPU, as well as temperature information obtained from the fixing section temperature detecting device 8.

Further, an auxiliary power control device 6*b* is provided to control power to be supplied to the fixing member 14 from the auxiliary power source 3 by turning on and off in accordance with temperature information of the fixing section temperature detecting device 8 as the main power control device 6*a*.

As mentioned above, the auxiliary power source 3 is formed by connecting a plurality of capacitor cells formed from electrical double layer capacitors, and is enabled to supply power charged and stored by the main power source 2 to the heating section 1 when relatively larger power is needed to be supplied such as when a system starts up, sheets are continuously fed, etc., in addition to power from the main power source 2. Thus, power larger than that supplied by only the main power source 2 can be supplied to the image forming system.

Such an auxiliary power source 3 can employ an electric storage device that is formed in a module of 100 volts by serially connecting forty capacitor cells each having performances of a voltage about 2.5 Volt, about 800 F of an electrostatic capacity, an internal resistance of less than about 5 mΩ, a diameter of about 35 mm, and a length of about 100 mm. In order to balance voltages among respective cells when serially connecting those, a voltage balancing circuit (not shown) is employed. As a result, activity can be maintained stably for a long time period. Further, when an internal resistance of the cell is less than 5 mΩ and a larger current than 20 A flows when an image forming system starts, a voltage between terminals of the auxiliary power source 3 decreases by an amount less than that decreased when a lithium or nickel hydrogen battery or the like is used. Further, since a value of the capacitor is smaller than average, a large power can be obtained by less number of capacitor cells. Thus, it is advantageous in view of size and cost.

Thus, if the electric double layer capacitor, i.e., a large capacity chargeable (dischargeable) condenser, is utilized as an auxiliary power source 3, prompt charging and a long life can be advantageously obtained. Because, the electric double layer capacitor does not accompany chemical reaction as different from a secondary battery.

Specifically, when the auxiliary power source employing conventional nickel-cadmium battery is utilized as a secondary battery, a large amount of power can be supplied only by a few times a day at few hours interval, and is inconvenient. Because, from dozens of ten minutes to a few hours is needed even the battery is rapidly charged. To the contrary, when a electric condenser is used as an auxiliary power source, a charging up time period can be shorter, and is charged during absence of printing, i.e., when the main power source has spare power, and thus a number of times of heating with the auxiliary power source can be increased into a practically available level. Because, the condenser can be charged up within from about dozens of ten seconds to about a few minutes.

Since the nickel-cadmium battery should be repeatedly recharged by about 500 to about 1000 times, and has a shorter life when used as an auxiliary battery, it causes a problem of replacement labor. Because, a number of repeating times of charging and discharging is from about five hundred to about one thousand. In contrast, an auxiliary power source using a condenser can repeat charging and discharging by about ten thousand times, and does not deteriorates. Further, since being almost needless of liquid replacement and replenishment, maintenance can be substantially omitted.

Recently, a condenser capable of largely storing electric energy has been developed, and is adapted to an electric car or the like. For example, an electric double layer capacitor developed by Nippon Chemi-Con Corporation has an electrostatic capacity of about 2000 F when 2.5 volts is applied, and is enough to supply power for from a few seconds to dozens of ten seconds. NEC Corporation has realized a condenser named Hyper Capacitor having about 80 F. Further, Japan Electron Optics Laboratory (JEOL) Co., Ltd unveils a technology named a nano gate capacitor having from five to ten times of a withstand voltage of from 3.2 to 3.5 volts and an electronic energy density of from 50 to 75 wh/kg.

As mentioned above, power to be supplied to the heat applying section 1 can be supplied from the main power source 2 to the heat generation member 1*a*. However, power can simultaneously be supplied from the auxiliary power source 3 to the auxiliary heat generation member 1*b*. The auxiliary power source 3 can preserve power in cooperation with the charger 4, and supplies the power to the auxiliary heat generation member 1*b* at an optional time. Due to supplying power to the heat applying section 1 from the auxiliary power source 3 in addition to the main power source 2, larger power can be supplied thereto than that only supplied by the main power source 2.

Figure 5A:
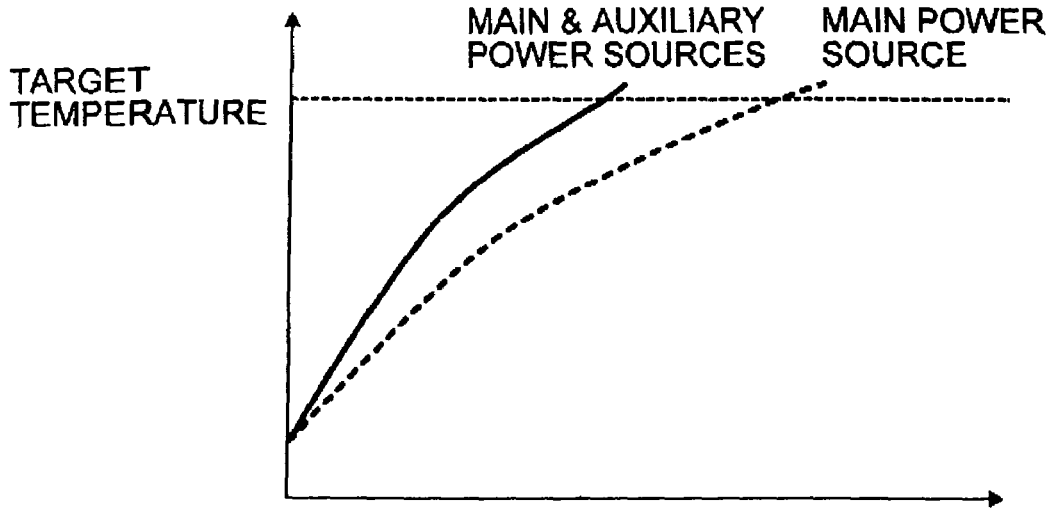
FIGS. 5A and 5B collectively illustrate an exemplary relation between a usage manner and a temperature increasing time period of both main and auxiliary power sources.

Thus, a temperature increasing time period can be shorter when both main and auxiliary powers are supplied up to when temperature of the heat applying section 1 becomes a predetermined level than when only the main power source is utilized as shown in FIG. 5A. For example, since initialization of respective systems or processes takes a long time period when a main power source is turned on and a image forming system starts up as a first thing in the morning, temperature does not need to quickly increase. Thus, the temperature is increased toward a target level only using the main power source, and is quickly increased by additionally using power from the auxiliary power source when an operation returns from a sleep mode.

Figure 5B:
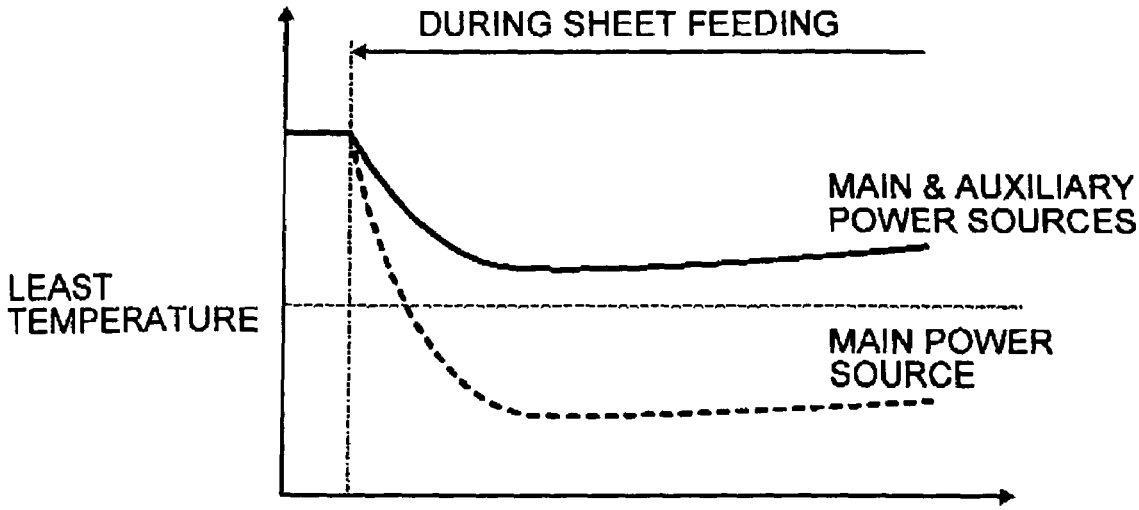

Further, as shown in FIG. 5B, even when only the main power source supplies power, a large amount of heat is then absorbed by continuously fed sheets, and temperature accordingly lowers a predetermined lowest level, a temperature dropping amount are reduced by additionally supplying power from the auxiliary power source. Thus, a high-speed image forming system capable of feeding many sheets per unit of time can be provided.

Figure 6:
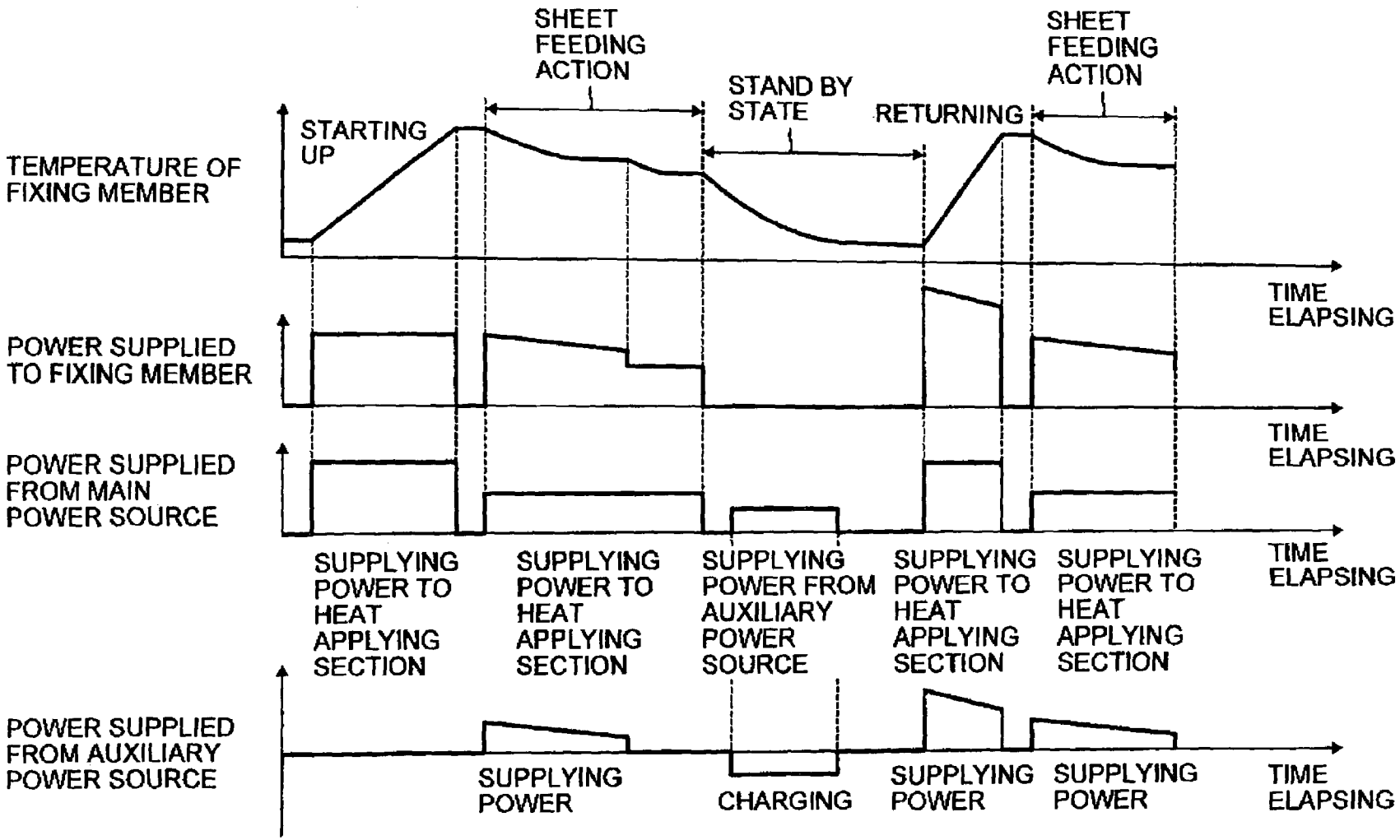
FIG. 6 illustrates an exemplary high-speed image forming apparatus capable of increasing temperature at high speed without dropping temperature of the fixing member using a thin roller.

FIG. 6 illustrates such a high-speed image forming system employing a thin roller as a fixing member 14 capable of quickly increasing temperature without dropping thereof. Specifically, in the initial state, an external power source such as a commercial power source, etc., supplies power and charges the auxiliary power source 3 that includes a large capacity condenser such as an quickly chargeable electric double layer capacitor. Since an electric self-discharging amount is small, the condenser can hold enough power through out about one night. Further, since the plug outlet is generally maintained connected, the commercial power source can charge even when a discharged amount lowers the prescribed level. Thus, it is unnecessary to wait for charging up when the main power source is turned on as a first thing in the morning to use an image forming system. However, since power from the auxiliary power source 3 is not used when the image forming system starts up as a first thing in the morning, it takes longer than before temperature increases to a prescribed level than when the image forming system returns while the auxiliary power is supplied in addition to the commercial power source.

When the image forming system starts up, and temperature of the fixing member 14 is to be quickly increased from atmosphere, larger power is totally supplied than when only the main power source 2 supplies if the auxiliary power source 3 supplies power to the heat applying section 1 in addition to the main power source 2. Thus, temperature of the fixing member 14 can be quickly increased. For example, when an aluminum thin roller having a thickness (t) of about 0.7 mm and a diameter of about 40 mm is utilized as a fixing member, and power of about 1200 watt is supplied from the auxiliary power source to the main heat generation member 1*a* in addition to that from the main power source. Namely, 2400 watt is totally supplied thereto, the temperature increasing time period, which takes 30 seconds when only the main power source is used, can be decreased down to about 15 seconds.

Since the auxiliary power source is formed from a capacitor as mentioned above, power gradually decreases from 1200 watt as a voltage decreases during power supplying. Thus, power becomes a significantly small level when a prescribed time has elapsed. Thus, even if temperature increases up to 500° C. where a sheet almost takes fire, a temperature increasing speed can be decreased. As a result, an image forming system capable of safely and quickly increasing temperature can be provided.

When power is increasingly supplied, the commercial power source supplies power via two routes. Otherwise, a secondary or fuel battery can be employed. However, since these systems continuously supply large power when a temperature is quickly to be increased, a reaction of a safety circuit for these cannot catch up temperature increasing speed. Thus, temperature of the heat applying section 1 becomes too high to avoid catching fire even when the safety circuit works in the worst situation. In contrast, when a capacitor is utilized, the heat generation member stops heating when a prescribed power has been consumed, and temperature automatically stops increasing, even if a system becomes out of control, and thereby power is continuously supplied.

Thus, a temperature increasing time period can be safely decreased using the capacitor as a heat source.

When a large number of sheets are fed per unit of time (i.e., at high speed), temperature of a thin roller accordingly decreases because of its thickness. Then, decreasing in temperature can be suppressed by supplying auxiliary power in addition to main power during sheet so as to quickly increase the temperature in view of a preferable usability. According to such a system, since power is utilized for the auxiliary heat generation member during the sheet through, larger power than that supplied from the main power source can be supplied thereto. Since decreasing in temperature just after sheet passage can be suppressed, a thin roller generally capable of forming an image by 60 cpm at most can do so by 75 cpm.

When the image forming system is in an idling state and the main power source 2 has a spare power, the main power source 2 charges the auxiliary power source 3. If a capacitor is used as an auxiliary power source, a charging up time can be decreased down to a few minutes. To even avoid the fixing member 14 from cooling for a few minutes, the auxiliary power source 3 is not needed, or used half way. Thus, the next user does not need waiting for charge completion, thereby the image forming system is convenient.

As mentioned above, an advantage impossible to be obtained by the secondary battery can be obtained for the first time by using the condenser as an auxiliary power source to heat the heat applying section 1.

Figure 7:
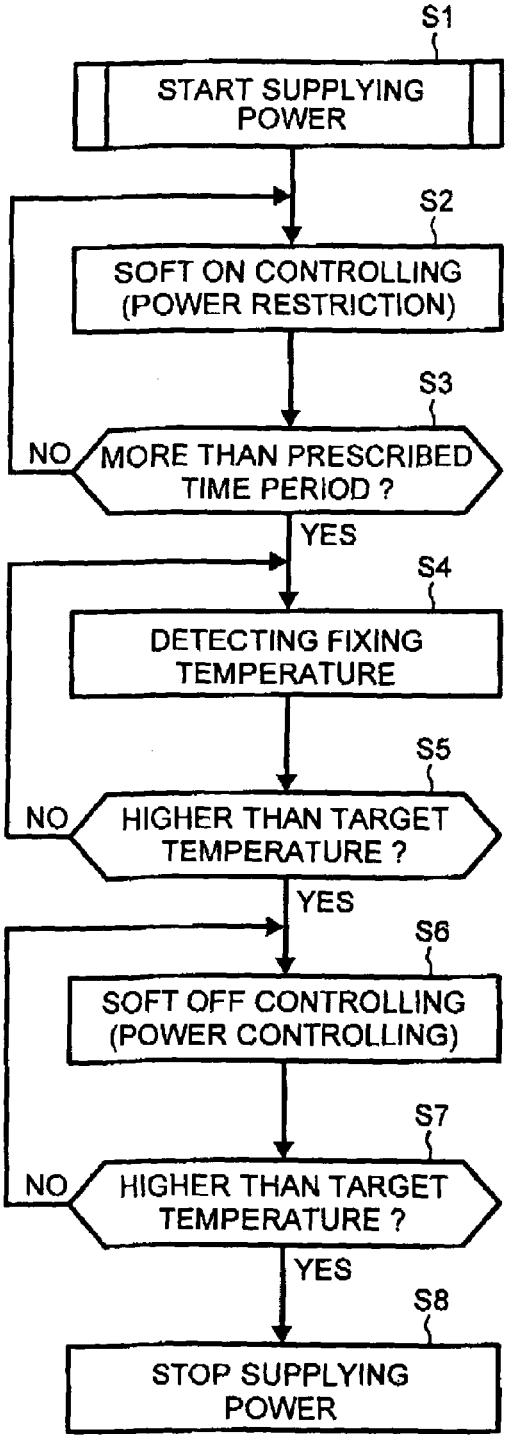
FIG. 7 illustrates an exemplary sequence of AC power supplying executed when an exemplary fixing apparatus starts up.

Now, an exemplary sequence of supplying AC power when an exemplary image forming system returns to a fixing mode and power is supplied from the main power source to the fixing section is described with reference to FIG. 7. First, soft ON control is implemented for a prescribed time period so as to restrict the AC power supplied to the fixing apparatus 10 in steps S1 to S3. As a result, the inrush current is suppressed. Further, soft OFF control is executed in step S6 when temperature of the fixing member 14 reaches a target level in step S5. Thus, the AC power is stopped being supplied while gradually restricting the AC power in the same manner as in the soft on control after the temperature of the fixing member 14 reaches the target level, thereby decreasing a back electromotive voltage in step S7.

Figure 8:
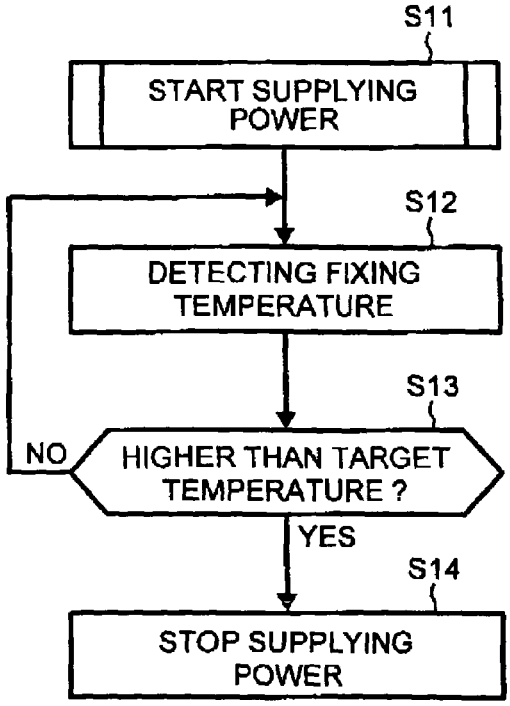
FIG. 8 illustrates an exemplary sequence of DC power supplying executed when an exemplary fixing apparatus starts up.

Now, an exemplary sequence of supplying DC power when an image forming system operates is described with reference to FIG. 8. When temperature of the fixing member 14 is detected and a prescribed DC power supply starting condition is satisfied, the DC power is immediately supplied from the auxiliary power source to the fixing section in step S11. It is then determined if a prescribed DC power supply ending condition is satisfied by detecting temperature in step S13. If the determination is positive, power supply with the DC is immediately terminated in step S14. Specifically, soft ON and OFF controls are implemented in supplying the DC power neither when the image forming system returns to a fixing mode and the DC power is supplied from the auxiliary power source 3 to the fixing member 14, nor when the temperature of the fixing member 14 reaches the target level and the DC power is stopped being supplied. Thus, temperature of the filament of the halogen heater constituting the heat applying section 1 can be quickly increased, while suppressing time lag generally caused when the fixing roller as a fixing member 14 is heated.

Figure 9:
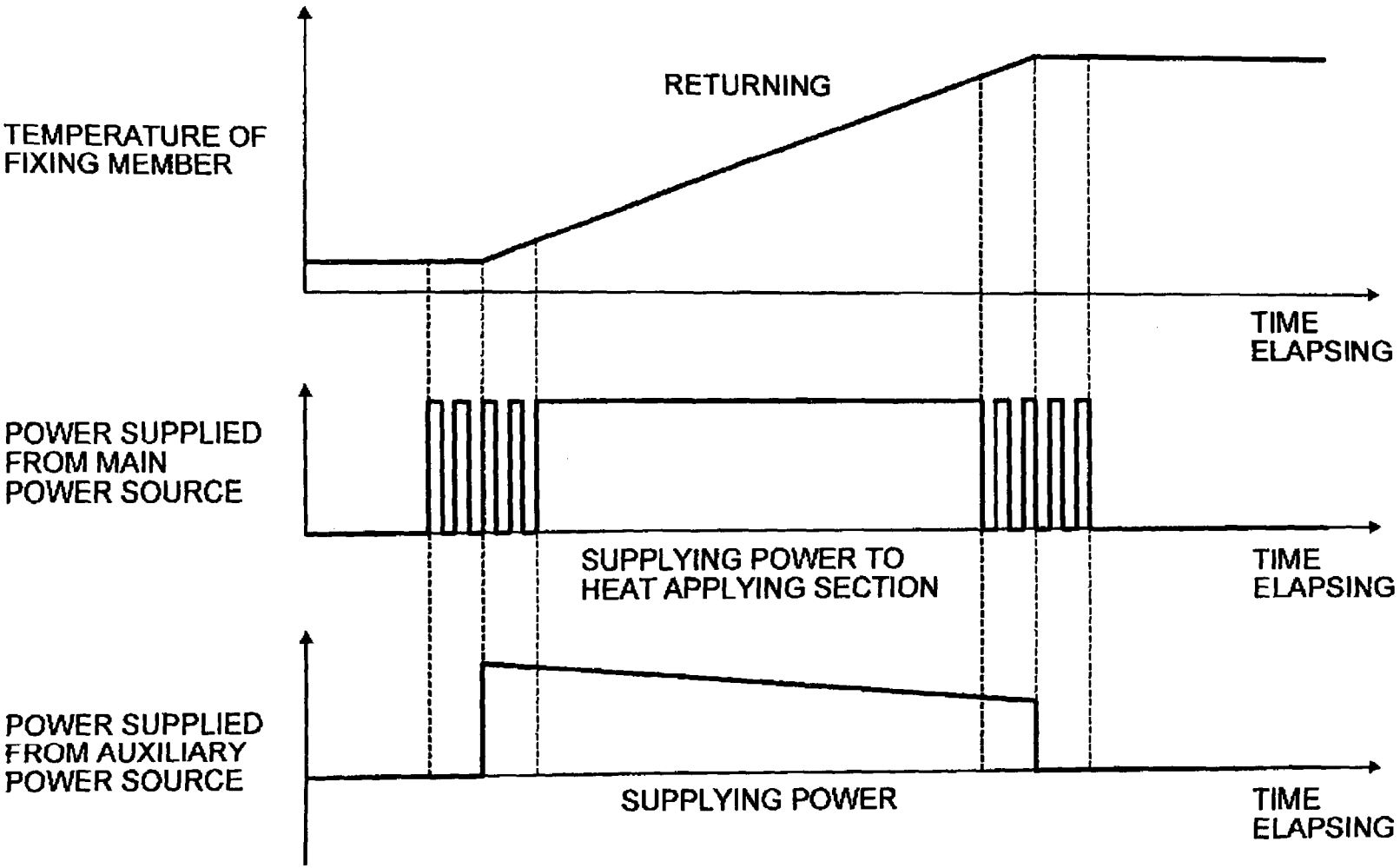
FIG. 9 illustrates an exemplary sequence of both AC and DC power supplying executed when an exemplary apparatus starts up.

Another exemplary sequence of supplying AC and DC power from the main power source 2 and auxiliary power source 3 when returning to a fixing mode is now described with reference to FIG. 9. As shown, so called soft on control is executed when the main power source 2 starts supplying AC power. The auxiliary power source 3 starts supplying DC power before the soft on control is terminated, i.e., before a lighting activity completely starts up. However, the auxiliary power source 3 can start power supplying before the main power source 2 starts supplying the AC power. Owing to this activity, delay in heading the fixing member 14 caused by the soft on control can be improved. Thus, usability is also improved.

Figure 10:
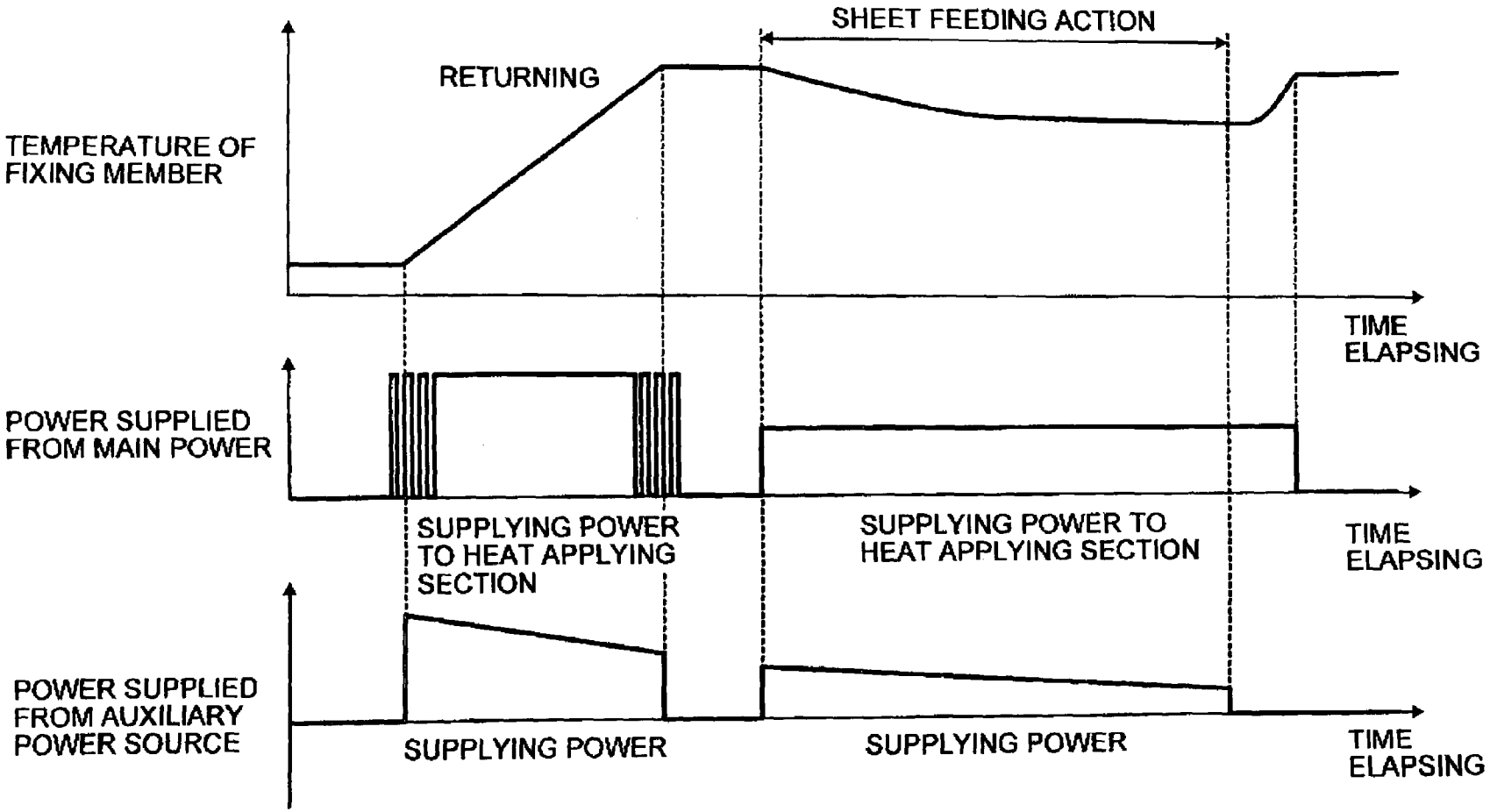

FIG. 10 illustrates another exemplary sequence of supplying AC and DC powers when sheets are fed. As shown, both the AC and DC powers are supplied and stopped being supplied when the sheets are fed and stopped, respectively.

Figure 11:
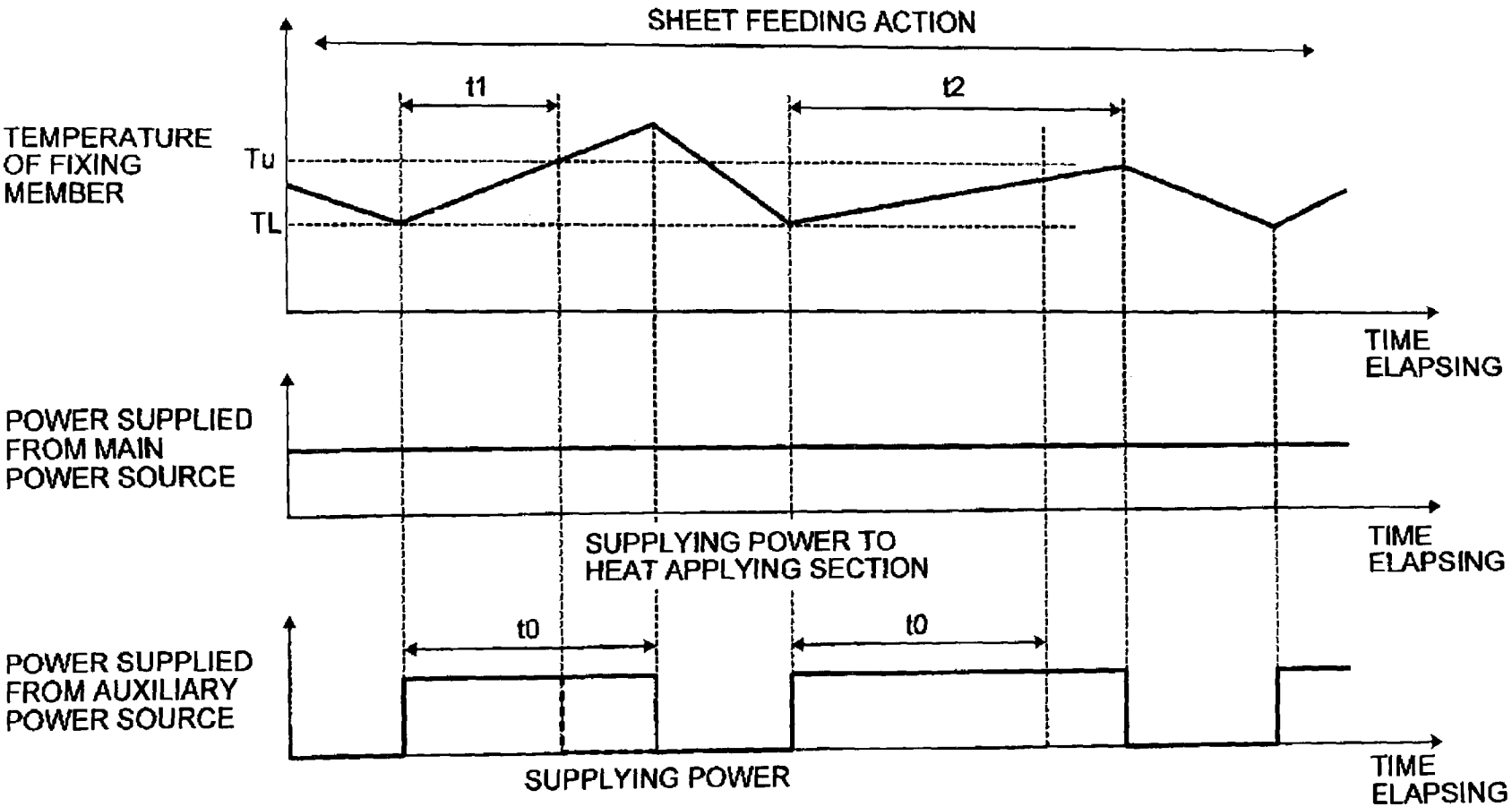
FIG. 11 illustrates another exemplary sequence of supplying both AC and DC powers according to a second embodiment of the present invention.

Now, a second embodiment is described with reference to FIG. 11. Specifically, an exemplary sequence of supplying AC and DC powers during sheet feeding while controlling temperature for about two to about ten seconds is illustrated. As shown, when temperature decreases, both the AC and DC powers are supplied. When temperature increases, only the AC power is continuously supplied. The DC power is, however, stopped being supplied when it is determined that a prescribed time period has elapsed after starting supplying the DC power and the determination is positive.

Temperature of the fixing member 14 generally varies in accordance with not only amounts of the AC and DC power supplied from the main power source 2 and auxiliary power source 3, but also a reading mode such as sheet through, etc., and an image area or the like. FIG. 11 illustrates a situation that temperature of the fixing member 14 cannot be maintained only by the AC power supplied from the main power source 2. Then, decreasing in temperature during continuous sheet feeding is avoided by supplying the DC power from the auxiliary power source 3.

When temperature of the fixing member 14 becomes less than TL (e.g. 180° C.), the auxiliary power source 3 starts supplying power. When temperature of the fixing member 14 starts increasing and becomes more than Tu (e.g. 185° C.), the auxiliary power source 3 stops supplying power as shown by a dotted line in FIG. 11. However, according to the second embodiment, when temperature of the fixing member 14 exceeds the Tu, and accordingly, the auxiliary power source 3 should be conventionally turned off, the auxiliary power source 3 is not turned off as shown by a solid line in FIG. 11. Specifically, an off signal is outputted to a semiconductor-switching element, such as a FET, etc., only when a prescribed time period to (e.g. 1.2 seconds) has elapsed after starting supplying the DC power.

For example, since a time period t1 (e.g. 0.8 seconds) is shorter than that of the to, the auxiliary power control device 6*b* is turned off when the prescribed time period to has elapsed. In contrast, since a time period t2 (e.g. 1.5 seconds) is longer than that of the to, when temperature of the fixing member 14 is detected as being higher than the Tu, an off signal is outputted to the semiconductor switching element, and the auxiliary power control device 6*b* is turned off. As a result, the auxiliary power source 3 is turned off.

The prescribed time period to starts when the auxiliary power source 3 supplies the DC power to the heat generating member 1*b* and an inrush current starts flowing. The reason for setting the 1.2 seconds is that a diameter of the filament is designed large so that the halogen heater of the auxiliary power source 3 can obtain a large power with a low voltage, and accordingly, an inrush current flows for a long time period. A value of 0.6 seconds can be set to the prescribed time period t0 when the auxiliary power source is designed to have a large voltage.

Thus, by turning off the auxiliary power source 3 only when a prescribed time period has elapsed after its tuning on, the inrush current of the halogen heater can sufficiently be settled, while suppressing a damage on the semiconductor-switching element of the auxiliary power source 3. Even though the DC heater is employed, an AC heater can be employed because the DC heater has a problem of a low voltage. Numerous additional modifications and variations of the present invention are possible in light of the above teachings. It is therefore to be understood that within the scope of the appended claims, the present invention may be practiced otherwise that as specifically described herein.

What is claimed is:

1. A method for supplying power to at least two heat generating members included in a fixing device, comprising:

supplying a first power to a first heat generating member from a commercial power source;

executing soft on control as to the first heat generating member for a predetermined period such that the first power is in a restricted state when a temperature of the fixing device starts increasing;

charging an auxiliary power source to store charge using the commercial power source;

supplying a second power from the auxiliary power source to a second heat generating member before the executing soft on control is terminated;

heating the fixing device with the first and second heat generating members; and fixing an image onto a recording medium using the fixing device after the temperature of the fixing device reaches a prescribed level.

2. The method as recited in claim 1, wherein restricting the first power for a predetermined period such that the first power is in the restricted state when the temperature of the fixing device first starts increasing after an image forming apparatus including the fixing device is first powered on from a sleep or off state.

3. The method according to claim 1, wherein said soft on control is performed by controlling a duty cycle for turning on a power supply.

4. A fixing apparatus, comprising:

a first heat generating member configured to generate heat upon receiving power from a commercial power source;

an auxiliary power source configured to store charge when charged by the commercial power source;

a second heat generating member configured to generate heat upon receiving power from the auxiliary power source;

a fixing member heated by the first and second heat generating members and configured to fix an image onto a recording medium; and a control device configured to execute soft on control as to the first heat generating member for a predetermined period such that the power supplied from the commercial power source to the first heat generating member is in a restricted state when the temperature of the fixing member starts increasing;

wherein said auxiliary power source starts supplying power to the second heat generating member before the control device terminates restriction of the power.

5. The apparatus as recited in claim 4, wherein the control device is configured to restrict the power supplied from commercial power source to the first heat generating member for a predetermined period such that the power supplied from the commercial power source to the first heat generating member is in the restricted state when the temperature of the fixing member first starts increasing after an image forming apparatus including the fixing apparatus is first powered on from a sleep or off state.

6. An image forming apparatus including the fixing apparatus as claimed in claim 4.

7. An image forming apparatus, comprising:

a fuser configured to fuse an image onto a recording medium;

a control device configured to charge an auxiliary power source;

the fuser including:

a first heat generating member configured to generate heat upon receiving power from a commercial power source;

a second heat generating member configured to generate heat upon receiving power from the auxiliary power source;

a fixing member heated by the first and second heat generating members;

the control device including:

a soft start circuit configured to execute soft on control as to the first heat generating member for a predetermined period in warm-up state;

wherein the control device starts supplying power to the second heat generating member from the auxiliary power source during the predetermined period.

8. The apparatus according to claim 7, wherein said soft on control is performed by controlling a duty cycle for turning on a power supply.

9. A method for supplying power to at least two heat generating members included in a fixing device, comprising:

supplying a first power to a first heat generating member from a commercial power source;

executing soft on control by alternating the power when a temperature of the fixing device starts increasing until alternating the power terminates at a point when the temperature of the fixing member is still increasing;

charging an auxiliary power source to store charge using the commercial power source;

supplying a second power from the auxiliary power source to a second heat generating member before the executing soft on control is terminated;

heating the fixing device with the first and second heat generating members; and fixing an image onto a recording medium using the fixing device after the temperature of the fixing device reaches a prescribed level.

10. The method according to claim 9, wherein said step of executing soft on control includes a sub step of controlling a duty cycle for turning on a power supply.

* * * * *